US011026557B2

(12) United States Patent
Woo et al.

(10) Patent No.: US 11,026,557 B2
(45) **Date of Patent: *Jun. 8, 2021**

(54) PUMP AND DISHWASHER COMPRISING THE SAME

(71) Applicant: LG Electronics Inc., Seoul (KR)

(72) Inventors: Sangwoo Woo, Seoul (KR); Minseong Kim, Seoul (KR); Hyungman Park, Seoul (KR)

(73) Assignee: LG Electronics Inc., Seoul (KR)

( * ) Notice: Subject to any disclaimer, the term of this patent is extended or adjusted under 35 U.S.C. 154(b) by 215 days.

This patent is subject to a terminal disclaimer.

(21) Appl. No.: 16/118,777

(22) Filed: Aug. 31, 2018

(65) Prior Publication Data

US 2019/0059690 A1 Feb. 28, 2019

(30) Foreign Application Priority Data

Aug. 31, 2017 (KR) ..... 10-2017-0111514

(51) Int. Cl.
*A47L 15/42* (2006.01)
*A47L 15/08* (2006.01)
(Continued)

(52) U.S. Cl.
CPC ..... *A47L 15/4234* (2013.01); *A47L 15/0015* (2013.01); *A47L 15/08* (2013.01); *A47L 15/4225* (2013.01); *F04D 13/16* (2013.01); *F04D 29/426* (2013.01); *F04D 29/586* (2013.01); *A47L 15/4285* (2013.01); *A47L 2601/04* (2013.01)

(58) Field of Classification Search
CPC ..... A47L 15/4234; A47L 15/4225; F04D 29/586; F04D 29/4293
See application file for complete search history.

(56) References Cited

U.S. PATENT DOCUMENTS

2012/0279527 A1 11/2012 Lee et al.
2015/0265133 A1 9/2015 Choi et al.
2017/0188778 A1 7/2017 Kim et al.

FOREIGN PATENT DOCUMENTS

KR 1020080006410 1/2008
KR 1020090060636 6/2009
(Continued)

OTHER PUBLICATIONS

Extended European Search Report in European Appln. No. Ep 15171571.1, dated Dec. 26, 2015, 13 pages.
(Continued)

*Primary Examiner* — Joseph L. Perrin
*Assistant Examiner* — Irina Graf
(74) *Attorney, Agent, or Firm* — Fish & Richardson P.C.

(57) ABSTRACT

A pump sends washing water and generates steam in order to wash the dishes or the cooking utensils, and a dishwasher including the same. The pump includes a housing, an impeller disposed inside the housing and configured to flow washing water, and a heater coupled to a lower side of the housing and configured to generate steam by heating the washing water in the housing. The housing includes a pump lower portion configured to receive the washing water based on rotation of the impeller, and a pump upper portion configured to discharge the washing water based on rotation of the impeller and to discharge the steam generated by the heater.

14 Claims, 8 Drawing Sheets

(51) Int. Cl.

| | |
|---|---|
| ***F04D 29/42*** | (2006.01) |
| ***F04D 29/58*** | (2006.01) |
| ***A47L 15/00*** | (2006.01) |
| ***F04D 13/16*** | (2006.01) |

(56) References Cited

FOREIGN PATENT DOCUMENTS

| | | |
|---|---|---|
| KR | 101678442 | 12/2016 |
| KR | 1020170012945 | 2/2017 |
| WO | WO2016028049 | 2/2016 |

OTHER PUBLICATIONS

PCT International Search Report in International Appln. No. PCT/KR2018/010056, dated Dec. 20, 2018, 3 pages.

PUMP AND DISHWASHER COMPRISING THE SAME

CROSS-REFERENCE TO RELATED APPLICATION

This application claims the priority benefit of Korean Patent Application No. 10-2017-0111514, filed on Aug. 31, 2017, in the Korean Intellectual Property Office, the disclosure of which is incorporated herein by reference.

FIELD

The present invention relates to a dishwasher, and more particularly, to a pump which sends washing water and generates steam in order to wash the dishes or the cooking utensils, and a dishwasher including the same.

BACKGROUND

A dishwasher is a household appliance for washing up dirt such as food wastes on the dishes or the cooking utensils (hereinafter, referred to as 'washing object') by high-pressure washing water sprayed from a spray arm. The dishwasher generally includes a tub forming a washing chamber and a sump mounted on the bottom of the tub to store the washing water. Then, the washing water is moved to the spray arm by the pumping operation of a washing pump installed inside the sump, and the washing water moved to the spray arm is sprayed at high pressure through a spray hole formed in the spray arm. Then, the washing water sprayed at a high pressure impinges against the surface of the washing object, so that the dirt on the washing object falls to the bottom of the tub.

Meanwhile, the dishwasher performs washing of the washing object by using a heated washing water or performs sterilization by supplying steam to the washing object. Conventional dishwashers generally generate hot water or steam by heating washing water stored in the sump through a heater provided inside the sump. In this case, since the heater should be exposed to the inside of the sump to contact the washing water, the water level inside the sump should be controlled so that the heater is not exposed to prevent overheating of the heater. In addition, since the heat transfer is possible only when the heater is in contact with the washing water, there exists a problem in that the heat exchange efficiency is lowered as foreign matter adheres to the surface of the heater and durability is deteriorated as the surface of the heater is corroded.

In order to overcome such disadvantages, a dishwasher that installs the heater on a pump has recently been developed. In this case, the heater inside the pump heats the wash water to generate hot water or steam. However, there is a problem in that air is introduced or the washing water is discharged through a flow path for discharging the steam so that the pressure of the washing water spraying through the spray arm is lowered.

SUMMARY

The present invention has been made in view of the above problems, and provides a pump and a dishwasher that can generate steam and smoothly discharge the steam without deteriorating the performance of washing water spraying.

In accordance with an aspect of the present invention, a pump includes: a housing; an impeller which is disposed inside the housing and flows washing water; and a heater which is coupled to a lower side of the housing and generates steam by heating the washing water in the housing, wherein the housing includes: a pump lower portion through which the washing water is introduced by rotation of the impeller; and a pump upper portion through which the washing water flows out by rotation of the impeller and the steam generated by the heater flows out.

The pump upper portion includes: an upper chamber in which the impeller is disposed; a washing water outflow pipe through which the washing water is discharged; and a steam discharge pipe through which steam is discharged.

The steam discharge pipe is disposed to discharge the steam in a direction opposite to a direction in which the washing water flows out through the washing water outflow pipe.

The steam discharge pipe is disposed to discharge the steam in a direction opposite to a tangential direction of rotational direction of the impeller.

The steam discharge pipe has a cross-sectional area smaller than a cross-sectional area of the washing water outflow pipe.

The pump lower portion includes: a lower chamber in which a part of the heater is disposed; and a washing water intake pipe through which the washing water is introduced, wherein the steam discharge pipe is disposed to discharge the steam in the same direction as a direction of washing water inflow through the washing water intake pipe.

The steam discharge pipe has a lowest connection point with the upper chamber is higher than a lowest connection point of the washing water outflow pipe and the upper chamber.

The washing water outflow pipe is formed in a tubular shape whose axis of symmetry is perpendicular to a rotational axis of the impeller, the steam discharge pipe is formed in a tubular shape whose axis of symmetry is perpendicular to the rotational axis of the impeller, and the axis of symmetry of the steam discharge pipe is higher than the axis of symmetry of the washing water outflow pipe.

The heater is partly disposed inside the housing.

The heater includes: a heater cover which forms a bottom surface of the housing; and a heating element which is joined to a lower side of the heater cover and heats the heater cover.

A part of the heater cover protrudes upward and forms a space in which a part of the heating element is accommodated.

The heater cover is disposed between the heating element and the washing water inside the housing.

The heater cover is heated by the heating element and heats the washing water inside the housing.

The pump further includes a partition wall which divides the housing into the pump lower portion and the pump upper portion.

In accordance with another aspect of the present invention, a dishwasher includes: a tub which accommodates a washing object; a spray arm which sprays washing water into the tub; a steam nozzle which discharges steam into the tub; a sump in which the washing water is stored; and a pump which supplies the washing water stored in the sump to the spray arm and generates steam to supply the steam to the steam nozzle, wherein the pump includes: a pump lower portion which is connected to the sump; and a pump upper portion which is connected to the spray arm and the steam nozzle.

The pump upper portion is formed to discharge the steam in a direction opposite to a direction in which the sump is disposed.

The pump upper portion is formed such that a discharge direction of the washing water and a discharge direction of the steam are opposite to each other.

BRIEF DESCRIPTION OF THE DRAWINGS

The objects, features and advantages of the present invention will be more apparent from the following detailed description in conjunction with the accompanying drawings, in which.

DETAILED DESCRIPTION

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Hereinafter, the present invention will be described with reference to the drawings for explaining a pump and a dishwasher including the same according to embodiments of the present invention.

Figure 1:
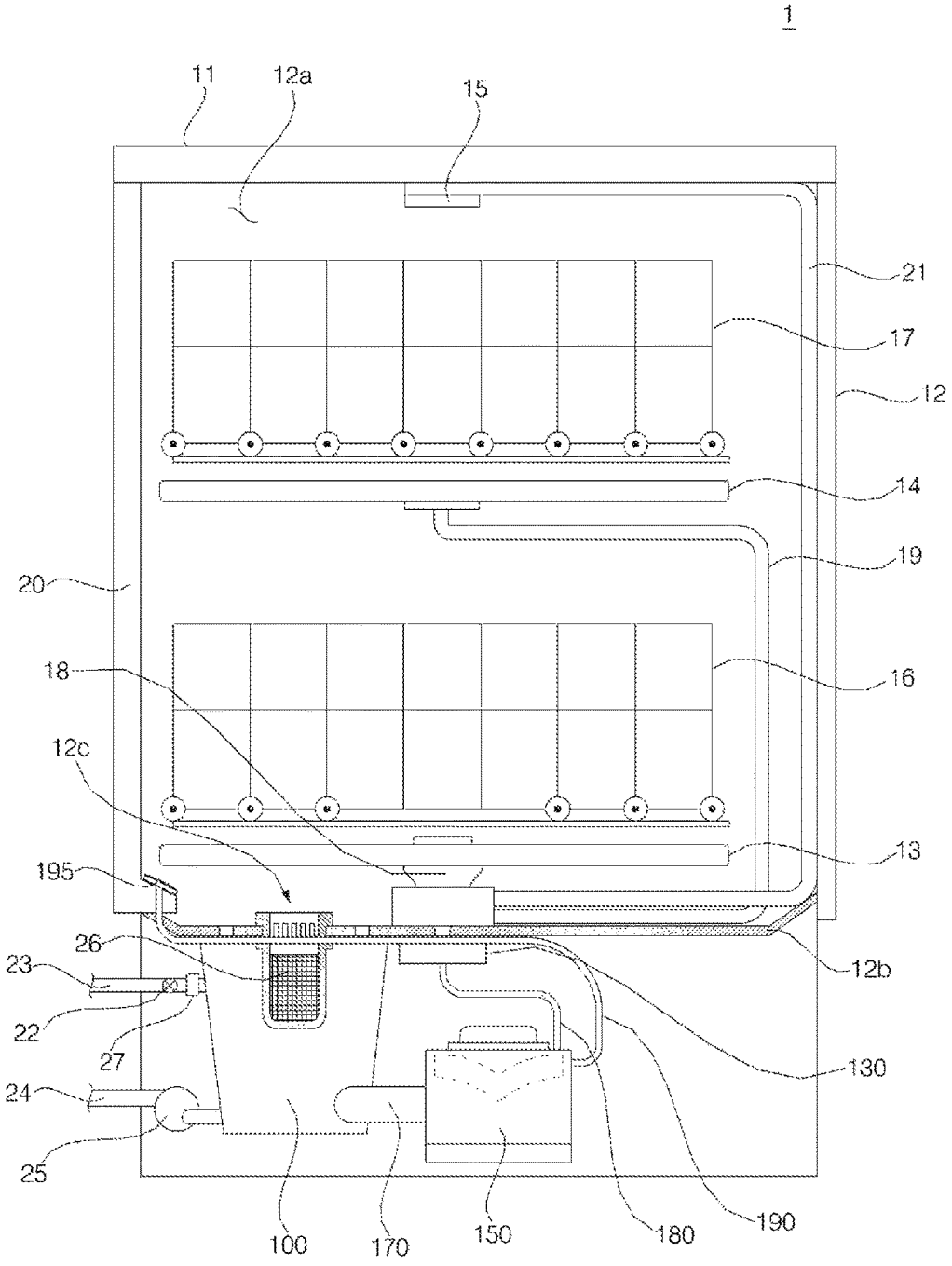
FIG. 1 is a schematic structural view of a dishwasher according to an embodiment of the present invention.

FIG. 1 is a schematic structural view of a dishwasher according to an embodiment of the present invention.

The dishwasher 1 according to an embodiment of the present invention includes a case 11 that forms an outer appearance, a tub 12 that is provided inside the case 11 and forms a washing chamber 12*a* in which a washing object is accommodated, a door 20 that is provided on the front of the tub 12 and opens and closes the washing chamber 12*a*, a sump 100 that is disposed below the tub 12 and stores washing water, a plurality of spray arms 13, 14, 15 that spray the washing water into the tub 12, a washing pump 150 that supplies the washing water stored in the sump 100 to the plurality of spray arms 13, 14, 15 and generates steam, a steam nozzle 195 that is provided in the door 20 and discharges the steam generated in the washing pump 150 into the tub 12, and a steam hose 190 that connects the washing pump 150 and the steam nozzle 195.

The tub 11 is formed in a hexahedron shape having an opened front surface and forms a washing chamber 12*a* therein. A communication hole 12*c* through which the washing water flows into the sump 100 is formed in a bottom 12*b* of the tub 11. The washing chamber 12*a* is provided with a plurality of racks 16 and 17 for receiving the washing object. The plurality of racks 16 and 17 include a lower rack 16 disposed at a lower portion of the washing chamber 12*a* and an upper rack 17 disposed at an upper portion thereof. The lower rack 16 and the upper rack 17 are vertically spaced apart and can be slid forwardly of the tub 11 to be drawn out.

The plurality of spray arms 13, 14, and 15 are disposed in the vertical direction. The plurality of spray arms 13, 14, and 15 include a lower spray arm 13 which is disposed in the lowermost end and sprays washing water from the lower side to the upper side toward the lower rack 16, an upper spray arm 14 which is disposed in the upper side of the lower spray arm 13 and sprays washing water from the lower side to the upper side toward the upper rack 17, and a top spray arm 15 which is disposed in the upper end of the washing chamber 12*a* that is above the upper spray arm 14 and sprays washing water from the upper side to the lower side.

The plurality of spray arms 13, 14, and 15 are supplied with the washing water from the washing pump 150 through a plurality of spray arm connecting flow paths 18, 19, and 21. The plurality of spray arm connecting flow paths 18, 19, and 21 include a lower spray arm connecting flow path 18 connected to the lower spray arm 13, an upper spray arm connecting flow path 19 connected to the upper spray arm 14, and a top spray arm connecting flow path 21 connected to the top spray arm 15.

The sump 100 is disposed below the bottom 12*b* of the tub 12 to collect washing water. The sump 100 is connected to a water supply flow path 23 through which washing water supplied from an external water source flows. The water supply flow path 23 is provided with a water supply valve 22 for controlling washing water supplied from the external water source. When the water supply valve 22 is opened, the washing water supplied from the external water source flows into the sump 100 through the water supply flow path 23. The water supply flow path 23 is provided with a flow meter 27 for measuring the flow rate of the washing water flowing into the sump 100 through the water supply flow path 23.

The sump 100 is connected to a drainage flow path 24 for guiding the stored washing water to the outside of the dishwasher 1. The drainage flow path 24 is provided with a draining pump 25 for draining the washing water in the sump 100 through the drainage flow path 24. When the draining pump 25 is operated, the washing water stored in the sump 100 flows to the outside of the case 11 through the drainage flow path 24.

A filter 26 is installed in the communication hole 12*c* to filter the dirt from the washing water moving from the tub 12 to the sump 100.

The washing pump 150 sends the washing water stored in the sump 100 to at least one of the plurality of spray arms 13, 14 and 15. The washing pump 150 is connected to a switching valve 130 and a washing water supply flow path 180. When the washing pump 150 is operated, the washing water stored in the sump 100 flows into the washing pump 150 through a water collecting flow path 170 and is then sent to the switching valve 130 through the washing water supply flow path 180. The washing pump 150 can heat the washing water transferred to the washing water supply flow path 180.

The washing pump 150 heats the washing water stored therein to generate steam. The washing pump 150 is connected to the steam hose 190. The steam generated in the washing pump 150 is supplied to the steam nozzle 195 through the steam hose 190.

The washing pump 150 is installed in one side of the sump 100. A detailed description of the washing pump 150 will be given later with reference to FIG. 2.

The steam nozzle 195 is provided in the lower end of the door 20 and discharges the steam into the washing chamber 12*a*. The steam discharged from the steam nozzle 195 is applied to the washing object accommodated in the lower rack 16 and/or the upper rack 17.

The switching valve 130 selectively supplies the washing water sent by the washing pump 150 to at least one of the lower spray arm 13, the upper spray arm 14, and the top spray arm 15. The switching valve 130 selectively connects the washing water supply flow path 180 and at least one of the plurality of spray arm connecting flow paths 18, 19, and 21. The switching valve 130 is disposed in the sump 100.

Figure 2:
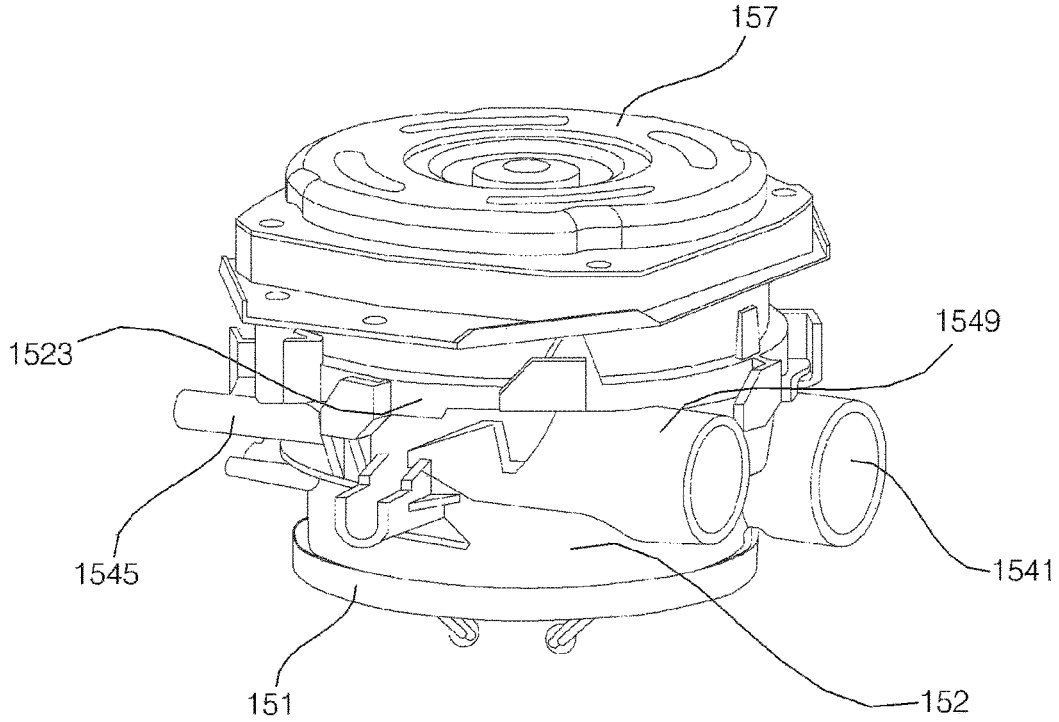
FIG. 2 is a perspective view of a washing pump according to an embodiment of the present invention.
Figure 3:
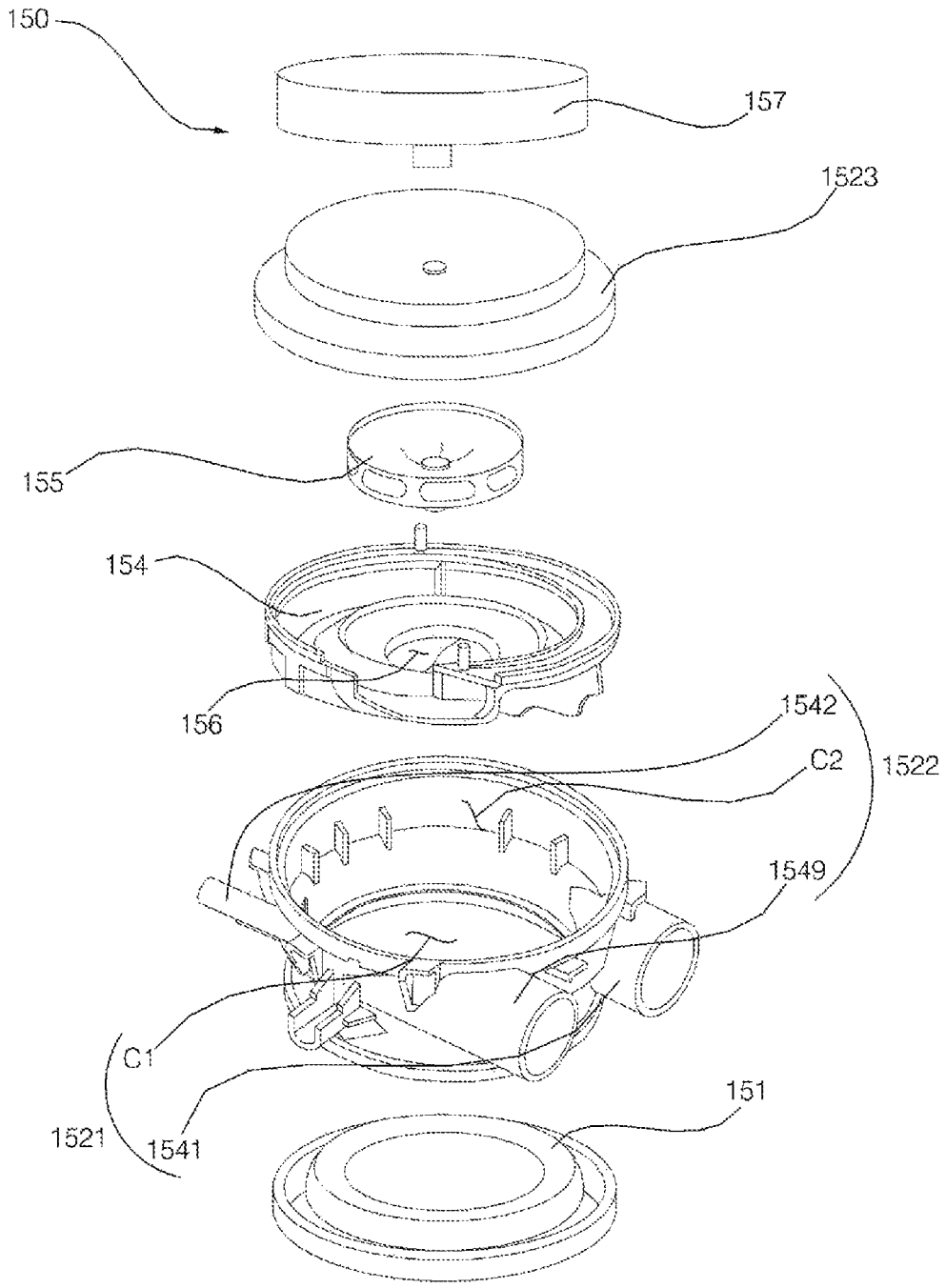
FIG. 3 is a schematic exploded perspective view of a washing pump according to an embodiment of the present invention.
Figure 4:
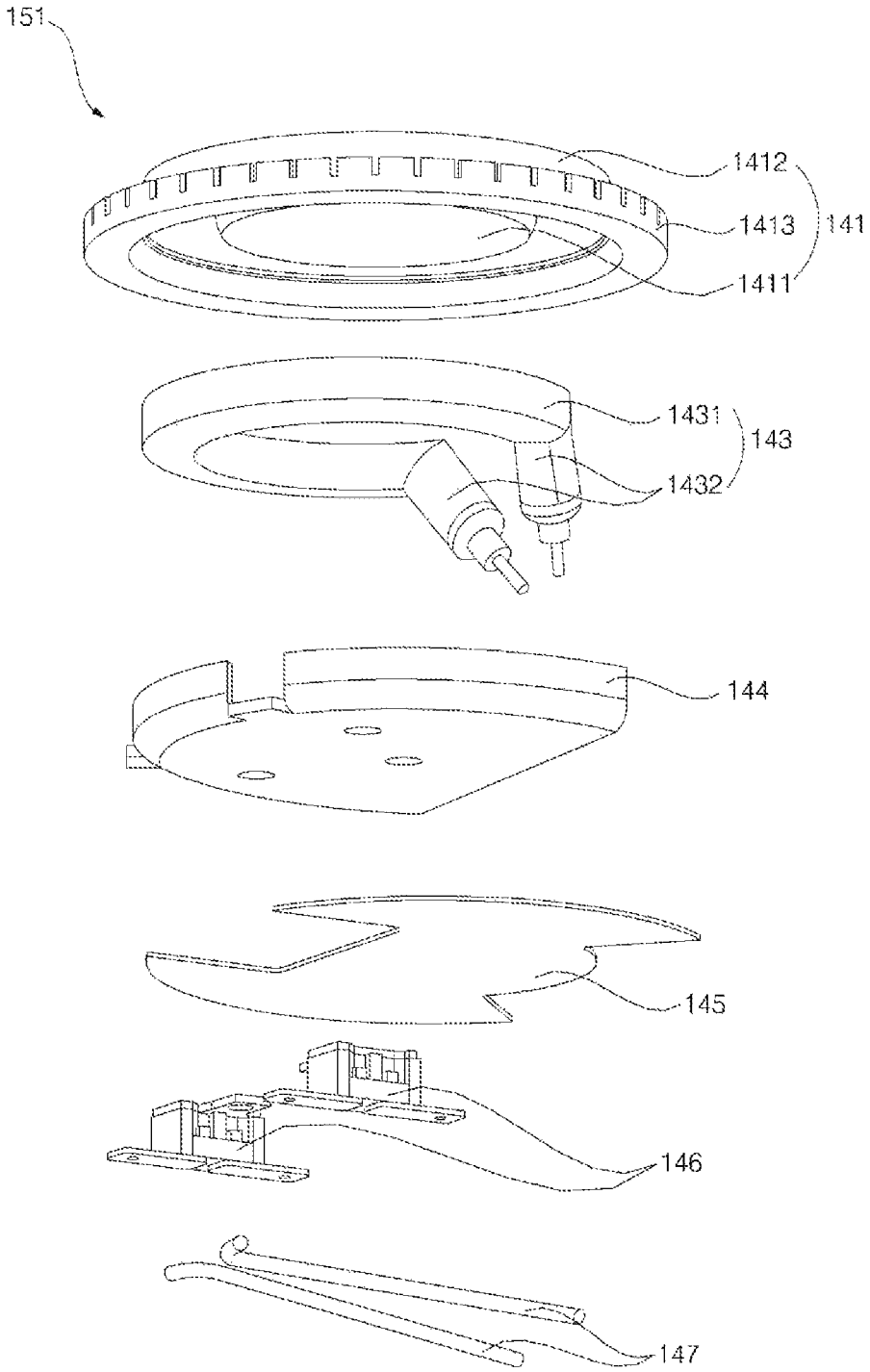
FIG. 4 is an exploded perspective view of a heater according to an embodiment of the present invention.
Figure 5:
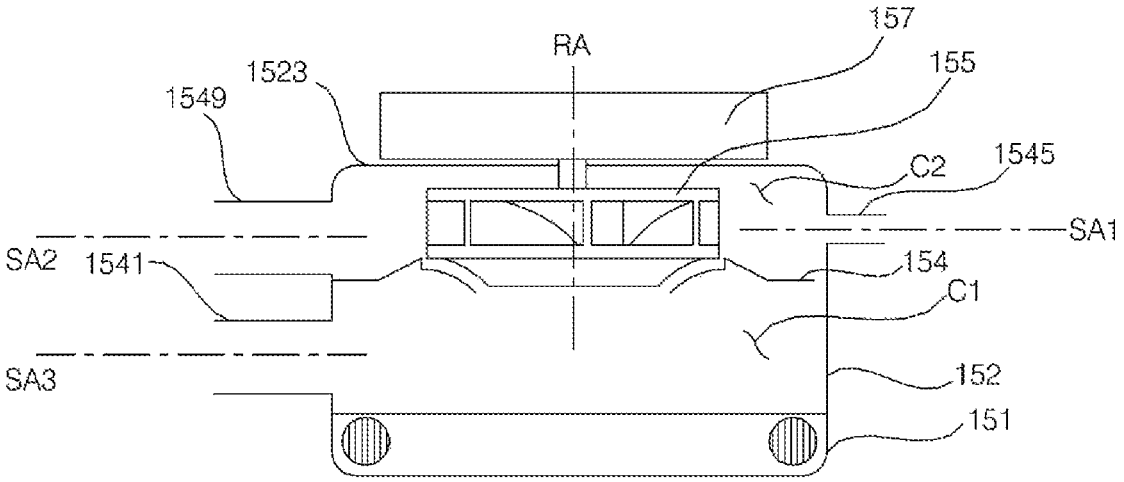
FIG. 5 is a schematic cross-sectional view of a washing pump according to an embodiment of the present invention.
Figure 6:
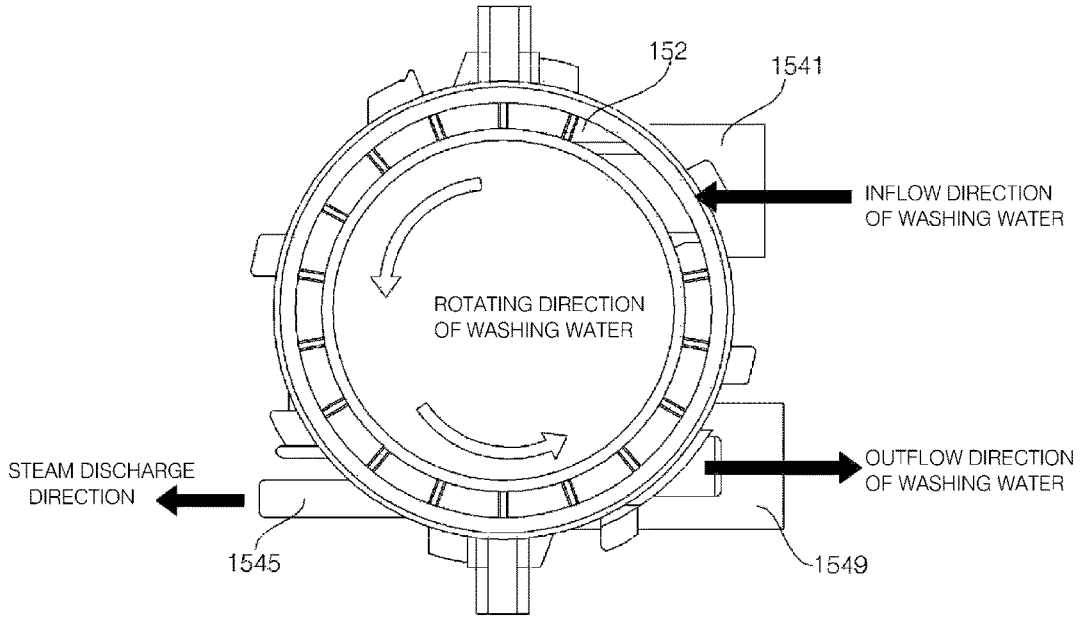
FIG. 6 is a plan view of a housing of a washing pump according to an embodiment of the present invention.

FIG. 2 is a perspective view of a washing pump according to an embodiment of the present invention, FIG. 3 is a schematic exploded perspective view of a washing pump according to an embodiment of the present invention, FIG. 4 is an exploded perspective view of a heater according to an embodiment of the present invention, FIG. 5 is a schematic cross-sectional view of a washing pump according to an embodiment of the present invention, and FIG. 6 is a plan view of a housing of a washing pump according to an embodiment of the present invention.

The washing pump 150 according to an embodiment of the present invention includes a cylindrical housing 152 that is coupled to the sump 100, an impeller 155 that flows washing water, a motor 157 that rotates the impeller 155, and a heater 151 that is coupled to the lower side of the housing 152 and generates steam by heating the washing water inside the housing 152.

The housing 152 is formed in a cylindrical shape having opened top and bottom surfaces. The housing 152 is coupled to the sump 100. A housing cover 1523 is coupled to the upper end of the housing 152, and the heater 151 is coupled to the lower end thereof. The housing cover 1523 covers the upper portion of the housing 152, and the housing cover 1523 is provided with a motor 157 for rotating the impeller 155 by generating a rotational force.

The housing 152 includes a pump lower portion 1521 through which the washing water is introduced by the rotation of the impeller 155, a pump upper portion 1522 through which the washing water flows out by the rotation of the impeller 155 and the steam generated by the heater 151 flows out, and a partition wall 154 which is disposed inside the housing 152 and divides an inner space vertically.

The pump lower portion 1521 includes a lower chamber C1 in which negative pressure is generated by the rotation of the impeller 155, and a washing water intake pipe 1541 which is connected to the housing 152 and through which washing water is introduced. The lower chamber C1 is formed in a cylindrical shape by the partition wall 154 and the lower portion of the housing 152. The lower portion of the lower chamber C1 is sealed by the heater 151. A part of the heater 151 is disposed in the lower chamber C1. The lower chamber C1 is connected to the sump 100 through the water collecting flow path 170 and the washing water intake pipe 1541.

The washing water intake pipe 1541 is connected to the lower chamber C1 side of the housing 152. The washing water intake pipe 1541 is connected to the water collecting flow path 170 and the washing water stored in the sump 100 is introduced through the water collecting flow path 170. The washing water stored in the sump 100 through the washing water intake pipe 1541 flows into the lower chamber C1. The washing water intake pipe 1541 is formed in a tubular shape in which an axis of symmetry SA3 (central axis of tube) is perpendicular to the axis of rotation RA of the impeller 155. The axis of symmetry SA3 of the washing water intake pipe 1541 is horizontally disposed so that the washing water flows in the horizontal direction. The washing water intake pipe 1541 is disposed to protrude in the tangential direction from the lower side wall of the housing 152.

The pump upper portion 1522 includes an upper chamber C2 in which a positive pressure is generated by rotation of the impeller 155, a washing water outflow pipe 1549 which is connected to the housing 152 and through which washing water is discharged, and a steam discharge pipe 1545 which is connected to the housing 152 and through which the steam generated by the heater 151 flows out.

The upper chamber C2 is formed in a cylindrical shape by the partition wall 154 and the upper portion of the housing 152. The impeller 155 is disposed inside the upper chamber C2. The upper portion of the upper chamber C2 is sealed by the housing cover 1523. The upper chamber C2 is connected to the switching valve 130 through the washing water outflow pipe 1549 and the washing water supply flow path 180. In addition, it is connected to the steam nozzle 195 through the steam discharge pipe 1545 and the steam hose 190.

The washing water outflow pipe 1549 is connected to the upper chamber C2 side of the housing 152. The washing water outflow pipe 1549 is connected to the washing water supply flow path 180 so that the washing water in the upper chamber C2 flows out into the washing water supply flow path 180. The washing water outflow pipe 1549 is disposed to protrude outward from the upper side wall of the housing 152. The washing water outflow pipe 1549 is formed in a tubular shape in which the axis of symmetry SA2 (central axis of tube) is perpendicular to the rotational axis RA of the impeller 155. The axis of symmetry SA2 of the washing water outflow pipe 1549 is horizontally disposed so that the washing water flows in the horizontal direction. The washing water outflow pipe 1549 is disposed to protrude in the tangential direction from the upper side wall of the housing 152.

The steam discharge pipe 1545 is connected to the upper chamber C2 side of the housing 152. The steam discharge pipe 1545 may be disposed at various positions of the housing 152 so as to connect the upper chamber C2 of the housing 152 and the steam hose 190. In the present embodiment, the steam discharge pipe 1545 is disposed in the washing water outflow pipe 1549. The steam discharge pipe 1545 discharges the steam which is generated inside the housing 152 by the heater 151 to the steam hose 190. The steam hose 190 is connected to the upper chamber C2 through the steam discharge pipe 1545. The steam discharge pipe 1545 is formed in a tubular shape in which the axis of symmetry SA1 (central axis of pipe) is perpendicular to the rotational axis RA of the impeller 155. The axis of symmetry SA1 of the steam discharge pipe 1545 is horizontally disposed so that the steam flows in the horizontal direction. The steam discharge pipe 1545 is disposed to protrude in the tangential direction from the lower side wall of the housing 152. The cross-sectional area of the steam discharge pipe 1545 is smaller than the cross-sectional area of the washing water outflow pipe 1549.

The partition wall 154 divides the inner space of the housing 152 into upper and lower portions to form the lower chamber C1 and the upper chamber C2. The partition wall 154 divides the housing 152 into the pump lower portion 1521 and the pump upper portion 1522.

The partition wall 154 is provided with a partition hole 156 for communicating the lower chamber C1 and the upper chamber C2. The surface 154 of the upper chamber C2 side (the upper surface) of the partition wall is formed in a volute shape so that the washing water flowing into the upper chamber C2 through the partition hole 156 from the lower chamber C1 is guided to the washing water outflow pipe 1549. A guider (not shown) protruding downward is formed on the lower surface of the lower chamber C1 side of the partition wall 154. The guider of the partition wall 154 guides the washing water introduced into the lower chamber C1 through the washing water intake pipe 1541 to the partition wall hole 156. The guider of the partition wall 154 allows the washing water in the lower chamber C1 to be uniformly heated by the heater 151.

The heater 151 is connected to the lower end of the housing 152 to form a bottom surface of the housing 152. The heater 151 heats the washing water flowing inside the housing 152 when the impeller 155 rotates. The heater 151 generates steam by heating the washing water stored in the housing 152 when the impeller 155 stops. A part of the heater 151 is disposed inside the housing 152.

Referring to FIG. 4, the heater 151 according to an embodiment of the present invention includes a heater cover 141 which forms a bottom surface of the housing 152, a heating element 143 which is joined to the lower side of the heater cover 141 and heats the heater cover 141, a heater plate 144 which is joined to the lower side of the heating element 143 and the heater cover 141 and transfers the heat of the heating element 143 to the heater cover 141, a thermostat 146 which supplies power to the heating element 143 and adjusts the temperature of the heating element 143, a wire 147 which electrically connects the heating element 143 and the thermostat 146, and a heater shield 145 which covers a part of the heater plate 144 from the lower side.

The heater cover 141 is coupled to the lower end of the housing 152 and forms the bottom surface of the housing 152 of the washing pump 150. The upper surface of the heater cover 141 is in contact with the washing water. The heater 143 and the heater plate 144 are joined to the lower side of the heater cover 141. The heater cover 141 is heated by the heating element 143 and the heater plate 144 to heat the washing water.

The circumference of the heater cover 141 is formed in a circular shape, and a plurality of bends in a vertical direction are formed at the position of concentric circle. The heater cover 141 is partly annularly protruded upward (toward the partition wall 154 side of the washing pump 150). A part of the heater cover 141 protrudes inward of the housing 152 to form an annular space in which a part of the heating element 143 is accommodated. A part of the heater cover 141 is disposed between the washing water accommodated in the housing 152 and the heating element 143. Thus, the heating element 143 is not in contact with the washing water accommodated in the housing 152.

The heater cover 141 includes a cover base 1411 having a disk shape, a cover holder 1412 protruding upward from the circumference of the cover base 1411, and a cover rim 1413 which is formed around the cover holder 1412 and is coupled with the housing 152.

The cover base 1411 is formed of a circular plate and forms a central portion of the heater cover 141. The central portion of the heater plate 144 is joined to the lower side of the cover base 1411. The cover base 1411 and the central portion of the heater plate 144 are joined by brazing.

The cover holder 1412 is formed in a ring shape protruding upward. The cover holder 1412 forms an annular space in which a part of the heating element 143 is accommodated. In the annular space of the cover holder 1412, a heating main body 1431 of heating element 143 described later is accommodated. A part of the heating element 143 is joined to the inside of the cover holder 1412. The cover holder 1412 and a part of the heating element 143 are joined by brazing.

The longitudinal section from the center to the radial direction of the cover holder 1412 is formed in an open curve whose lower side is open. At least part of the cover holder 1412 is formed to correspond to a part of the shape of the heating element 143 accommodated in the annular space of the cover holder 1412. The cover holder 1412 accommodates a part of the heating element 143 and is in direct contact with a part of the heating element 143. The inner surface of the outer circumference of the cover holder 1412 is spaced apart from the outer circumferential surface of a part of the heating element 143 accommodated in the annular space of the cover holder 1412.

The cover rim 1413 is formed in a rim shape. The cover rim 1413 is formed to surround the lower end of the housing 152. The circumferential end of the cover rim 1413 protrudes upward and is coupled with the housing 152. Since the cover rim 1413 is not in contact with the heater plate 144 and the heating element 143, it is heated to a relatively low temperature.

The heating element 143 receives power from the thermostat 146 through a wire 147 and generates heat. The heating element 143 heats the heater cover 141 and the heater plate 144. The heater cover 141 is joined to the upper side of the heating element 143 by brazing, and the heater plate 144 is joined to the lower side thereof by brazing.

The outer circumference of a part of the heating element 143 is spaced apart from the portion of the heater cover 141 forming an annular space. A part of the heating element 143 is accommodated in the annular space formed in the heater cover 141 and disposed inside the housing 152. The heating element 143 is disposed below the heater cover 141 forming the bottom surface of the housing 152 and disposed in the outside of the washing pump 150 but partially disposed in the inside of the housing 152.

The heating element 143 includes an arc-shaped heating main body 1431 for generating heat and a heating terminal 1432 for supplying power to the heating main body 1431.

The heating main body 1431 is formed in an arc shape whose center angle is larger than 180 degrees. The heating main body 1431 is accommodated inside the cover holder 1412. The upper surface and the inner circumferential surface of the heating main body 1431 come into contact with the heater cover 141 to heat the heater cover 141. The lower surface and the outer circumferential surface of the heating main body 1431 are brought into contact with the heater plate 144 to heat the heater plate 144. The heating main body 1431 is disposed higher than the lower end of the housing 152.

The heating terminal 1432 receives power from the thermostat 146 through the wire 147 and transfers the power to the heating main body 1431. A plurality of heating terminals 1432 are provided at both ends of the heating main body 1431. The plurality of heating terminals 1432 are extended from both ends of the heating main body 1431 and formed to be inclined downward. That is, the plurality of heating terminals 1432 are formed to protrude downward from a plane formed by the lower end of the heating main body 1431.

The heater plate 144 is heated by the heating element 143 to heat the cover base 1411 of the heater cover 141. The heater plate 144 uniformly distributes the heat of the heating element 143 to uniformly heat the heater cover 141. The heater plate 144 is formed in a bowl shape. The circumferential inner surface of the heater plate 144 is in contact with the heating element 143, but the circumferential outer surface thereof is spaced apart from the heater cover 141. A heater shield 145 is disposed below the heater plate 144.

Referring to FIG. 5, the axis of symmetry SA1 of the steam discharge pipe 1545 is disposed to be higher than the axis of symmetry SA3 of the washing water intake pipe 1541 and higher than the axis of symmetry SA2 of the washing water outflow pipe 1549. The diameter of the steam discharge pipe 1545 is smaller than the diameter of the washing water outflow pipe 1549. In the steam discharge pipe 1545, the lowest connection point with the housing 152 is higher than the lowest connection point between the washing water outflow pipe 1549 and the housing 152.

Referring to FIG. 6, the steam discharge pipe 1545 is disposed to discharge steam in a direction opposite to the direction of the washing water discharge through the washing water outflow pipe 1549. The steam discharge pipe 1545 is disposed to discharge the steam in the same direction as the direction of the inflow of the washing water through the washing water intake pipe 1541. The steam discharge pipe 1545 is disposed to discharge the steam in the direction opposite to the tangential direction of the rotating direction of the impeller 155 (the rotating direction of the washing water inside the pump upper portion 1522).

Due to the above-described structure, most of the washing water inside the upper chamber C2 flows out through the washing water outflow pipe 1549 when the impeller 155 rotates, and the outflow of washing water through the steam discharge pipe 1545 is minimized.

Figure 7:
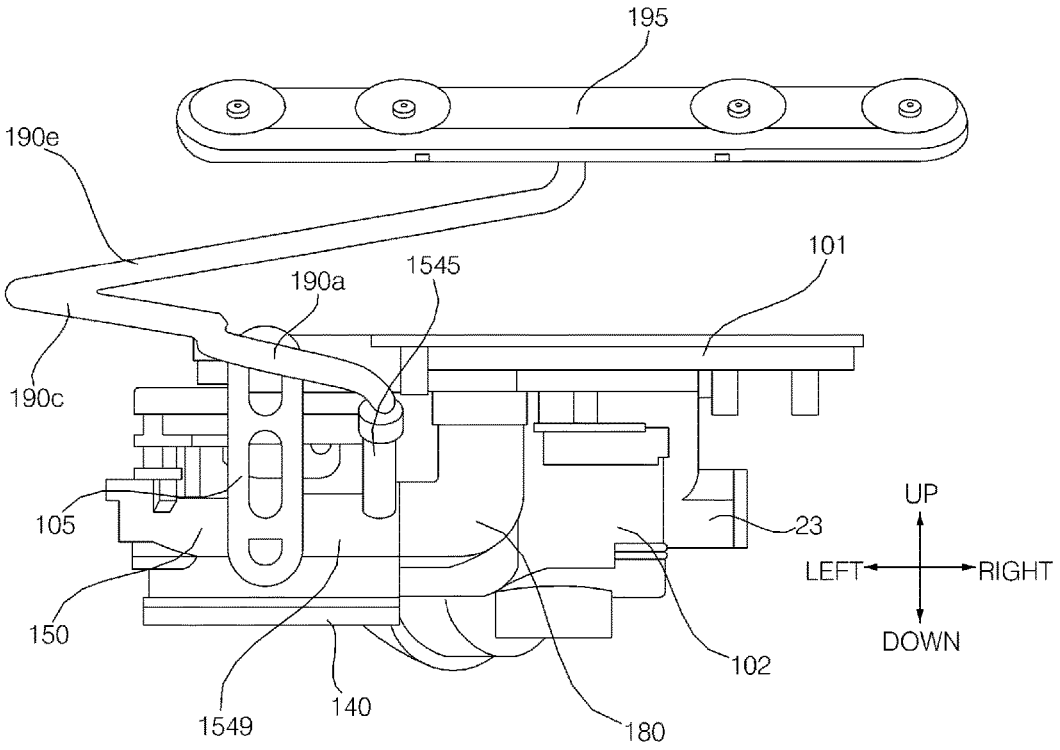
FIG. 7 is a plan view of a part of a dishwasher according to an embodiment of the present invention.
Figure 8:
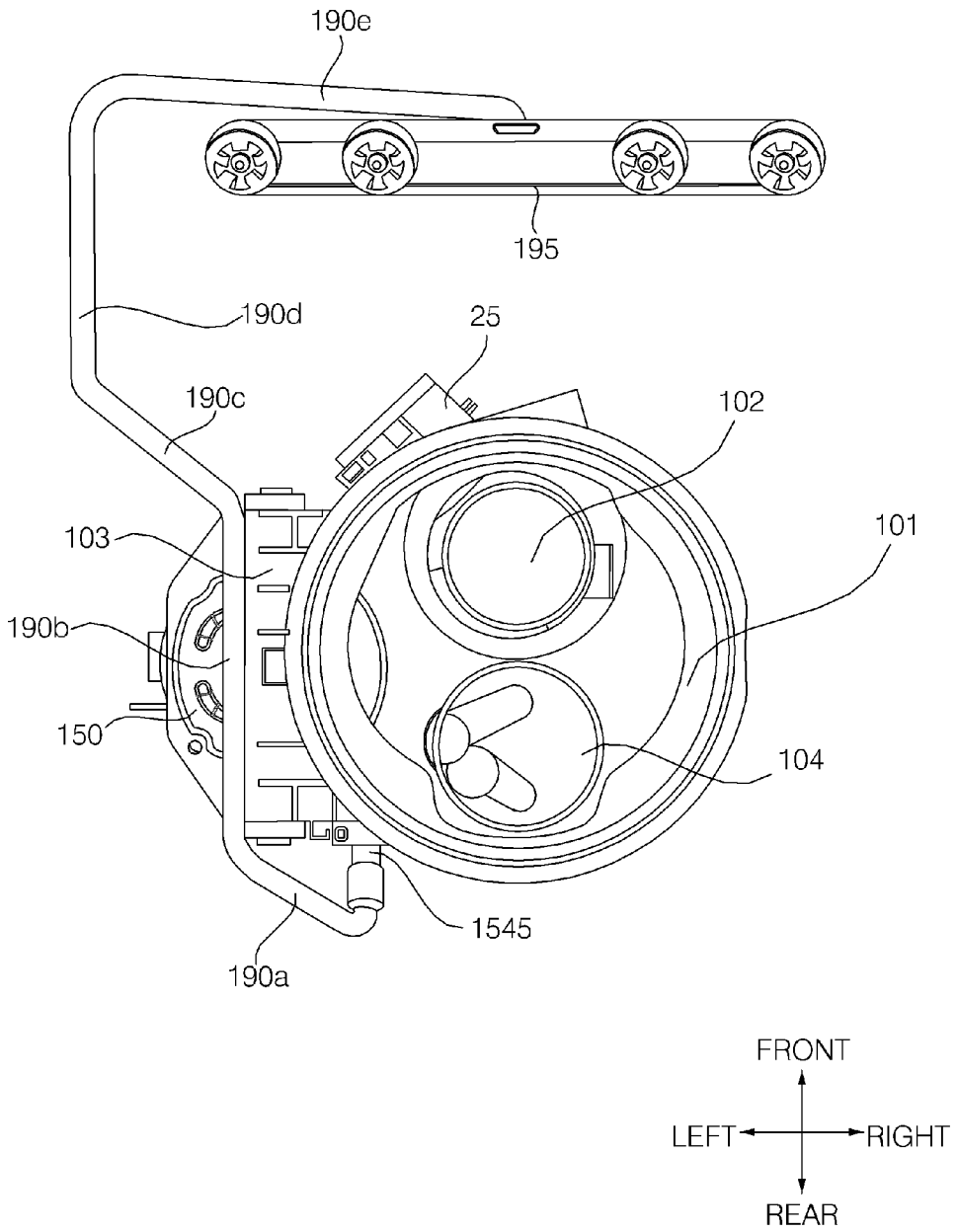
FIG. 8 is a partial rear view of a part of a dishwasher according to one embodiment of the present invention.

FIG. 7 is a plan view of a part of a dishwasher according to an embodiment of the present invention, and FIG. 8 is a partial rear view of a part of a dishwasher according to one embodiment of the present invention.

Hereinafter, the direction in which the door 20 is disposed based on the center of the dishwasher 1 is referred to as a front direction, and the opposite direction is referred to as a rear direction. In addition, the direction perpendicular to the front and rear direction on a horizontal plane is referred to as a right and left direction (lateral direction). In the right and left direction, the direction in which the washing pump 150 is disposed is referred to as a left lateral direction, and the opposite direction is referred to as a right lateral direction.

The sump 100 according to an embodiment of the present invention includes a sump body 101 coupled to the bottom 12*b* of the tub 12, a water collecting unit 102 for collecting washing water, and a valve coupling unit 104 in which the switching valve 130 is disposed.

The sump body 101 is disposed below the bottom 12*b* of the tub 12 and is coupled to the tub 12. The sump body 101 is formed roughly in a disc shape. An inclined surface for guiding the washing water to the water collecting unit 102 may be formed on the upper surface of the sump body 101.

The water collecting unit 102 is formed in a cylindrical shape to store the collected washing water. The water collecting unit 102 is disposed in the lower side of the communication hole 12*c* in correspondence with the communication hole 12*c* of the tub 12. The water collecting unit 102 is connected to the water supply flow path 23, and the washing water supplied from an external water source flows into the water collecting unit 102. The water collecting unit 102 is equipped with the draining pump 25 and connected to the drainage flow path 24 so that the washing water in the water collecting unit 102 is discharged through the drainage flow path 24. The water collecting unit 102 is connected to the water collecting flow path 170 to discharge the washing water in the water collecting unit 102 through the water collecting flow path 170.

The valve coupling unit 104 is provided with a switching valve 130. The valve coupling unit 104 may be a part of the switching valve 130. The valve coupling unit 104 is formed roughly in a circular shape. The valve coupling unit 104 is connected to the washing water supply flow path 180. The valve coupling unit 104 is provided with a supply hole 104*a* communicating with the washing water supply flow path 180.

In the present embodiment, the water collecting unit 102 and the valve coupling unit 104 are disposed in the sump body 101 in the front-rear direction. The water collecting unit 102 is disposed in front of the valve coupling unit 104.

The washing pump 150 is disposed in one lateral side of the sump 100. In the present embodiment, the washing pump 150 is disposed in the left lateral side of the sump 100. That is, the washing pump 150 is disposed in the left lateral side of the water collecting unit 102 and the valve coupling unit 104.

The washing water intake pipe 1541 and the washing water outflow pipe 1549 of the washing pump 150 are disposed toward the sump 100. The washing water intake pipe 1541 is disposed toward the water collection unit 102 and the washing water outflow pipe 1549 is disposed toward the valve coupling unit 104. The washing water intake pipe 1541 is disposed such that the inflow direction of the washing water is a left lateral direction, and the washing water outflow pipe 1549 is disposed such that the outflow direction of the washing water is a right lateral direction.

The steam discharge pipe 1545 of the washing pump 150 is disposed to discharge the steam in a direction opposite to the direction in which the sump 100 is disposed (right lateral direction) based on the washing pump 150. The steam discharge pipe 1545 is disposed to discharge the steam toward the left lateral direction. The steam discharge pipe 1545 is disposed in the rear side of the housing 152 of the washing pump 150 such that the axis of symmetry SA1 is the left and right direction.

Due to the above-described structure, the steam hose 190 connecting the steam discharge pipe 1545 and the steam nozzle 195 disposed in the front can be disposed without interfering with the sump 100 and the washing pump 150. Further, the bending of the steam hose 190 can be minimized. The steam hose 190 is preferably coupled to and supported by the bottom 12*b* of the tub 12.

According to the pump and the dishwasher including the same of the present invention, one or more of the following effects can be obtained.

First, the steam discharge pipe through which the steam in the pump is discharged is coupled to the upper chamber of the pump, so that air in the tub is not introduced into the pump.

Second, the steam discharge pipe is disposed to face the opposite direction of the washing water outflow pipe through which the washing water flows out, thereby minimizing the leakage of washing water through the steam discharge pipe.

Third, the steam discharge pipe is disposed to discharge the steam in a direction opposite to the tangential direction of the rotating direction of the washing water in the pump, thereby minimizing the leakage of washing water through the steam discharge pipe.

Fourth, the steam discharge pipe is disposed in a direction opposite to the direction toward the sump so that the connection with the steam nozzle for discharging the steam into the tub is facilitated.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A pump comprising:

a housing configured to receive washing water;

an impeller that is located inside the housing and that is configured to rotate with respect to the housing, the impeller being configured to cause flow of washing water; and a heater that is coupled to a lower side of the housing, that is configured to heat washing water in the housing, and that is configured to generate steam from washing water in the housing, wherein the housing comprises:

a pump lower portion configured to receive washing water based on rotation of the impeller, a pump upper portion configured to, based on rotation of the impeller, discharge washing water and steam from the housing, the pump upper portion defining an upper chamber that accommodates the impeller, and a partition wall that divides the housing into the pump lower portion and the pump upper portion, and wherein the pump upper portion comprises:

a washing water outflow pipe disposed above the partition wall and configured to discharge washing water in a first direction, and a steam discharge pipe disposed above the partition wall and configured to discharge steam in a second direction opposite to the first direction.

2. The pump of claim 1, wherein the steam discharge pipe is oriented to discharge steam in a direction opposite to a tangential direction of rotation of the impeller.

3. The pump of claim 1, wherein a cross-sectional area of the steam discharge pipe is less than a cross-sectional area of the washing water outflow pipe.

4. The pump of claim 1, wherein the pump lower portion comprises:

a lower chamber configured to accommodate a part of the heater; and a washing water intake pipe configured to receive washing water in an inflow direction, and wherein the steam discharge pipe is oriented to discharge steam in the inflow direction.

5. The pump of claim 1, wherein the steam discharge pipe is connected to the upper chamber at a first connection portion, wherein the washing water outflow pipe is connected to the upper chamber at a second connection portion, and wherein a lowermost point of the first connection portion is vertically above a lowermost point of the second connection portion.

6. The pump of claim 1, wherein the washing water outflow pipe has a tubular shape that extends along a first axis in a direction perpendicular to a rotational axis of the impeller, wherein the steam discharge pipe has a tubular shape that extends along a second axis in a direction perpendicular to the rotational axis of the impeller, and wherein the second axis of the steam discharge pipe is vertically above the first axis of the washing water outflow pipe.

7. The pump of claim 1, wherein at least a part of the heater is located inside the housing.

8. The pump of claim 1, wherein the heater comprises:

a heater cover that defines a bottom surface of the housing; and a heating element coupled to a lower side of the heater cover and configured to heat the heater cover.

9. The pump of claim 8, wherein a part of the heater cover protrudes upward from the bottom surface of the housing to define a space configured to accommodate a part of the heating element.

10. The pump of claim 8, wherein the heater cover is configured to be positioned between the heating element and washing water received in the housing.

11. The pump of claim 8, wherein the heater cover is configured to, based on being heated by the heating element, heat washing water received in the housing.

12. The pump of claim 1, wherein the washing water outflow pipe and the steam discharge pipe extend along a first axis that is perpendicular to a rotational axis of the impeller, the first axis passing through the washing water outflow pipe and the steam discharge pipe.

13. The pump of claim 12, wherein the pump lower portion comprises a washing water intake pipe that is disposed below the partition wall, that extends parallel to the first axis, and that is configured to receive washing water.

14. The pump of claim 13, wherein the washing water outflow pipe and the washing water intake pipe are disposed at a first side with respect to the rotational axis of the impeller, and wherein the steam discharge pipe is disposed at a second side with respect to the rotational axis of the impeller.

* * * * *